US006387861B1

(12) United States Patent
Van Asperen et al.

(10) Patent No.: US 6,387,861 B1
(45) Date of Patent: May 14, 2002

(54) DETERGENT COMPOSITIONS

(75) Inventors: Anja Leonarda M Van Asperen, Vlaardingen; Atze Jan Van der Goot, Wageningen, both of (NL); Rene Lammers, Bangkok (TH); Seeng Djiang Liem; Robert Ernst Niemantsverdriet, both of Vlaardingen (NL); Mark Van der Veen, Wageningen (NL); Patrick Van der Waal, Vlaardingen (NL)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/569,686

(22) Filed: May 12, 2000

(30) Foreign Application Priority Data

May 21, 1999 (GB) ..... 9911949

(51) Int. Cl.[7] ..... C11D 17/00; C11D 3/386; C11D 3/39

(52) U.S. Cl. ..... 510/298; 510/349; 510/376; 510/392; 510/446

(58) Field of Search ..... 510/298, 349, 510/376, 392, 446

(56) References Cited

U.S. PATENT DOCUMENTS

| | | | | |
|---|---|---|---|---|
| 5,658,874 A | * | 8/1997 | Davies et al. | 510/446 |
| 5,900,399 A | * | 5/1999 | Seiter et al. | 510/446 |
| 6,194,368 B1 | * | 2/2001 | Waschenbach et al. | 510/224 |

FOREIGN PATENT DOCUMENTS

| | | |
|---|---|---|
| CA | 2226143 | 1/1997 |
| DE | 198 06 220 | 8/1999 |
| EP | 395 333 | 10/1990 |
| EP | 481 792 | 4/1992 |
| EP | 481 793 | 4/1992 |
| EP | 711 827 | 5/1996 |
| EP | 737 738 | 10/1996 |
| EP | 976 819 | 2/2000 |
| EP | 976 820 | 2/2000 |
| GB | 911204 | 11/1962 |
| WO | 90/02165 | 3/1990 |
| WO | 95/18215 | 7/1995 |
| WO | 97/03177 | 1/1997 |
| WO | WO-98/55590 A1 * | 12/1998 |
| WO | 99/35225 | 7/1999 |
| WO | 99/35229 | 7/1999 |
| WO | 99/35230 | 7/1999 |
| WO | 99/35231 | 7/1999 |
| WO | 99/35232 | 7/1999 |
| WO | 99/35233 | 7/1999 |
| WO | 99/35234 | 7/1999 |
| WO | 99/35235 | 7/1999 |
| WO | 99/35/236 | 7/1999 |

* cited by examiner

*Primary Examiner*—Lorna M. Douyon
(74) *Attorney, Agent, or Firm*—Rimma Mitelman

(57) ABSTRACT

A detergent tablet for fabric washing is compacted from a particulate composition containing detergent active compound, detergency builder, a bleach system comprising coated sodium percarbonate and at least one bleach activator, and optionally other detergent ingredients, where the tablet comprises a plurality of discrete regions, and wherein the bleach activator and the coated sodium percarbonate are concentrated in respective different regions of the tablet. This separation of activator and percarbonate increases the stability of the bleach activator.

8 Claims, No Drawings

DETERGENT COMPOSITIONS

This invention relates to tablets of compacted particulate detergent composition suitable for washing fabrics.

Detergent compositions in tablet form have been described in a number of documents including, for example, GB 911204 (Unilever), WO 90/02165 (Henkel) and EP-A-711827 (Unilever) and are sold now commercially. Tablets have several advantages over powdered products: they do not require measuring and are thus easier to handle and dispense into the washload, and they are more compact, hence facilitating more economical storage.

One issue that has been considered in the formulation of detergent tablets is the incorporation of bleaching ingredients, especially when the presence of bleach-sensitive ingredients such as enzymes and perfume is also desired. In a compressed tablet, the ingredients are much more intimately associated with one another than in a powder, and it would be foreseen that any adverse interactions and instability will be exacerbated.

It has become commonplace to use an inorganic peroxygen bleach jointly with a bleach activator. The latter is usually an organic compound which reacts with the peroxygen bleach in the wash liquor to generate a bleaching species such as peracetic acid which is effective at lower wash temperature than the bleach.

EP 737 738 (Clean tabs) discloses bleach tablets comprising coated sodium percarbonate and a bleach activator (TAED). However, this document does not teach the separation of the percarbonate and the bleach activator. The bleach tablets are intended to be used together with usual textile detergent compositions.

EP 0 481 793A (Unilever) is aimed at solving the particular storage problems that arise when sodium percarbonate, $Na_2CO_3.1.5H_2O_2$, is included in a tablet formulation. This persalt is less stable than sodium perborate in the presence of moisture, and hence more readily undergoes premature decomposition in which hydrogen peroxide is liberated and this decomposes readily. The solution proposed is to separate the sodium percarbonate from any other ingredient of the composition detrimental to its stability by segregation in a discrete region of the tablet.

This segregation can be achieved by isolating the percarbonate in a region of the tablet which may be a layer, core or insert, while other ingredients are present in other region (s), which may be other layers or the main body or matrix of the tablet. Alternatively, it is suggested that the percarbonate is present in regions which are relatively large granules or noodles distributed throughout the main body or matrix of the tablet, the granules or noodles being protected by coating or encapsulation with a water-soluble material.

Examples in the application demonstrated that percarbonate decomposition occurs even in the absence of bleach activator and is reduced when the percarbonate is segregated into discrete region(s).

EP 481 792 (Unilever) discloses a laundry detergent tablets containing a particulate bleaching composition which may comprise a bleach activator.

GB 911 204 (Unilever) discloses layered detergent tablets containing persalt bleach, for example, sodium perborate, and certain bleach activators, for example, sodium acetoxybenzene sulphonate and phthalic anhydride. To avoid destabilisation, the bleach activator is segregated from the remaining tablet ingredients, including persalt bleach.

Segregation is achieved by putting the bleach activator in a separate section or layer.

In contrast, EP 395 333A (Unilever) disclosed detergent tablets containing sodium perborate in conjunction with one or more bleach-sensitive ingredients—tetraacetylethylenediamine (TAED) or similar bleach activator, enzyme, fluorescer, or any combination of these—as well as detergent-active compound, detergency builders and optionally other ingredients. The persalt is not segregated from the bleach-sensitive ingredients.

This document taught that segregation of bleach activator from the perborate bleach was not necessary for TAED and similar activators. When compositions were prepared containing both perborate and TAED together, and then stored either as powders or as tablets compacted from those powders, a loss of bleaching activity during storage was observed but there was no significantly greater loss in tablets. In a number of instances the tablets showed better bleaching after storage than did powders where the ingredients are not in such close proximity.

This document also showed a similar finding when enzymes were incorporated in powders with the bleaching system and a comparison was made of enzyme stability both in these powders and in tablets compacted from the powders. During storage the decomposition of enzyme in tablets, where the compaction had necessarily brought the enzyme into closer proximity with the bleaching system was not significantly greater and in some cases was less than observed with powders.

WO 99/35225 and WO 99/35229 to WO 99/35236 (Henkel) all disclose segregation of ingredients within double layer laundry detergent tablets.

Surprisingly, it has now been found that the stability of the bleach sensitive ingredients can be further increased by encapsulating the sodium percarbonate and in addition segregating these sensitive ingredients from (encapsulated) sodium percarbonate, even though stability of percarbonate is not much affected by such "double segregation". Therefore, in a first aspect, the present invention provides a tablet of compacted particulate detergent composition comprising a detergent-active compound, a detergency builder, a bleach system comprising sodium percarbonate in the form of particles having a coating of water-soluble material together with bleach activator which is preferably at least one bleach activator selected from N-diacylated and N,N'-polyacylated amine bleach activators, and optionally other detergent ingredients, which tablet comprises a plurality of discrete regions, each of which is at least 10% of the total weight of the tablet, and wherein the bleach activators and the particles containing the sodium percarbonate within a water-soluble coating are concentrated in respective different regions of the tablet.

In a second aspect, the present invention provides a tablet of compacted particulate detergent composition comprising a detergent active compound, a detergency builder, a bleach system comprising sodium percarbonate in the form of particles having a coating of water-soluble material, at least one enzyme and optionally other detergent ingredients, where the tablet comprises a plurality of discrete regions each of which is at least 10% of the total weight of the tablet and wherein the said enzyme and the particles containing the sodium percarbonate within a water-soluble coating are concentrated in respective different regions of the tablet.

It will be appreciated that in this invention both bleach activator and enzyme may be incorporated in the same region(s) of the tablet while sodium percarbonate is concentrated in a different region or regions.

Preferably a region or regions in which sodium percarbonate is concentrated contain at least 80% better at least 90% or 95% of the sodium percarbonate present in the tablet and better still all of it. It is preferred that such regions contain at most 20% of all the bleach activator and/or at most 20% of a detergent enzyme present in the tablet, more preferably less than this. Correspondingly a region or regions in which bleach activator is concentrated or in which an enzyme is concentrated preferably contain at least 80% of the bleach activator or respectively enzyme present in the tablet more preferably at least 90% or 95% of the bleach activator or enzyme and at most 20% preferably at most 10% or 5% of the percarbonate present in the tablet.

If more than one enzyme is used in a tablet, it is possible but not preferred, to segregate one enzyme but not segregate another enzyme from the coated percarbonate. Preferably all the enzyme types present are segregated together so that one or more regions contain at least 90 or 95% of all enzyme but not more than 20% of the percarbonate. There may well be complete segregation so that regions which contain bleach, enzyme, or both, are free of percarbonate.

As will be mentioned in more detail below, tablets of this invention may contain water-soluble or water-insoluble detergency builder but the invention is particularly applicable to tablets which contain water-insoluble aluminosilicate detergency builder. The discrete region(s) are preferably in the form of layers of the tablet having two or more layers but other possibilities also exist.

Materials which may be incorporated in tablets of this invention, preferences concerning these materials, and other features will now be described and exemplified in more detail.

Discrete Regions

The discrete regions may be in the form of layers, and a tablet with two layers is one preferred embodiment of the present invention. One layer of this two-layer tablet contains the coated sodium percarbonate particles, and the other layer the particles of the bleach activator. Each layer of such a tablet is preferably substantially homogeneous, that is to say, is the compaction product of a single particulate composition, although that particulate composition may have been prepared by mixing a number of components and all its particles will not necessarily be identical. Typically, such a two-layer tablet is made on a tableting press by part filling the die with the composition of the first layer, pressing this layer, and then adding the composition of the second layer before pressing the tablet for a second time. It is preferred that the two layers of this tablet are not equal in size—a weight ratio of 10:90 to 40:60 is preferable, and a ratio of 20:80 to 30:70 is more preferred, with a ratio of 25:75 being most preferred. Usually, the percarbonate particles are present in the larger layer.

An alternative preferred embodiment of the invention is a tablet which has a pair of opposite faces spaced apart from each other and joined by a peripheral surface of the tablet, wherein the tablet is subdivided into at least two regions which are each visible at a said face. One such tablet is one having a central core passing through the whole tablet. One particular method of manufacturing such tablets is described in our copending application, GB 9901688.3.

Other forms of discrete regions are known for detergent tablets and are included in the present invention, and include cores which do not pass all the way through the tablet and a central region completely enclosed by an outer region.

Sodium Percarbonate Granules

The granules of sodium percarbonate used in the present invention require a coating of water-soluble material. Suitable coating materials should be water-soluble, and not sensitive to the presence of bleach. They include sodium sulphate, sodium carbonate, sodium chloride and sodium borate. It is possible that the coating material will be a mixture of such materials.

It is unlikely that the coating material will exceed 20% by weight of the whole granule. Typically, the coating material will be less than 5% by weight of the whole granule, preferably less than 3% by weight. The minimum amount of coating material is determined by the requirement that the sodium percarbonate is fully encapsulated, but is likely to be at least 1% by weight, more preferably 2% by weight.

Coated sodium percarbonate granules are commercially available for example from Solvay, who manufacture granules coated with a sodium carbonate/sodium chloride mixture and Kemira who supply granules coated with sodium sulphate.

Bleach Activator

Preferred bleach activators are acylated amine bleach activators which have been widely disclosed in the art. Preferred examples include peracetic acid precursors, for example tetraacetylethylene diamine (TAED), which is widely used in detergent powders.

A bleach activator is required in tablets of the first aspect of the present invention, but may also be present in tablets of the second aspect. Bleach activator is usually present in an amount from 1 to 10% by weight of the tablet.

Other Bleach System Ingredients

A bleach system may also include a bleach stabiliser (heavy metal sequestrant) such as ethylenediamine tetramethylene phosphonate, diethylenetriamine pentamethylene phosphonate, and ethylenediamine disuccinate (EDDS).

Perfumes

Perfumes are known to be sensitive to the presence of bleaching systems and show a surprising increase in storage stability in tablets of the first aspect of the present invention, compared to tablets where only one form of segregation of the sodium percarbonate and bleach activator is used. Thus it is preferred that tablets of the first aspect contain a perfume. This perfume nay be present in only one region of the tablet, but can be present in the region containing coated percarbonate, and may be present throughout the whole tablet.

As is well known, a perfume normally consists of a mixture of a number of perfumery materials, each of which has a fragrance. The number of perfumery materials in a perfume is typically ten or more. The range of fragrant materials used in perfumery is very wide; the materials come from a variety of chemical classes, but in general are hydrophobic oils. In many instances, the molecular weight of a perfumery material is in excess of 150, but does not exceed 300.

Although the invention is not limited to specific perfumery materials, some perfumery materials which may be used include: acetyl cedrene; 4-acetoxy-3-pentyltetrahydropyran; 4-acetyl-6-t-butyl-1,1-dimethylindane, available under the trademark "CELESTOLIDE"; 5-acetyl-1,1,2,3,3,6-hexamethylindane, available under the trademark "PHANTOLIDE"; 6-acetyl-1-isopropyl-2,3,3,5-tetramethylindane, available under the trademark "TRASEOLIDE"; alpha-n-amylcinammic aldehyde; amyl salicylate; aubepine; aubepine nitrile; aurantion; 2-t-butylcyclohexyl acetate; 2-t-butylcyclohexanol; 3-(p-t-butylphenyl)propanal; 4-t-butylcyclohexyl acetate; 4-t-butyl-3,5-dinitro-2,6-dimethyl acetophenone; 4-t-butylcyclohexanol; benzoin siam resinoids; benzyl benzoate; benzyl acetate; benzyl propionate; benzyl salicylate; benzyl isoamyl ether; benzyl alcohol; bergamot oil; bornyl acetate; butyl salicylate; carvacrol; cedar atlas oil; cedryl methyl ether; cedryl acetate; cinnamic alcohol; cinnamyl propionate; cis-3-hexenol; cis-3-hexenyl salicylate; citronella oil; citronellol; citronellonitrile; citronellyl acetate: citronellyloxyacetaldehyde; cloveleaf oil; coumarin; 9-decen-1-ol: n-decanal; n-dodecanal; decanol; decyl acetate; diethyl phthalate; dihydromyrcanol; dihydromyrcenyl formate; dihydromyrcenyl acetate; dihydroterpinyl acetate; dimethylbenzyl carbinyl acetate; dimethylbenzylcarbinol; dimethylheptanol; dimyrcatol; diphenyl oxide; ethyl naphthyl ether; ethyl vanillin; ethylene brassylate; eugenol; geraniol; geranium oil; geranonitrile; geranyl nitrile; geranyl acetate; 1,1,2,4,4,7-hexamethyl-6-acetyl-1,2,3,4-tetrahydronaphthalene, available under the trademark "TONALID"; 1,3,4,6,7,8-hexahydro-4,6,6,7,8,8-hexamethylcyclopenta-2-benzopyran, available tinder the trademark "GALAXOLIDE"; 2-n-heptylcyclopentanone; 3a,4,5,6,7,7a-hexahydro-4,7-methano-1(3)H-inden-6-ylpropionate, available under the trademark "FLOROCYCLENE"; 3a,4,5,6,7,7a-hexahydro-4,7-methano-1(3)H-inden-6-ylacetate, available under the trademark "JASMACYCLENE"; 4-(4'-hydroxy-4'-methylpentyl)-3-cyclohexenecarbaldehyde; alpha-hexylcinammic aldehyde; heliotropin; Hercolyn D; hexyl aldone; hexyl cinnamic aldehyde; hexyl salicylate; hydroxycitronellal; i-nonyl formate; 3-isocamphylcyclohexanol; 4-isopropylcyclohexanol; 4-isopropylcyclohexyl methanol; indole; ionones; irones; isoamyl salicylate; isoborneol; isobornyl acetate; isobutyl salicylate; isobutylbenzoate; isobutylphenyl acetate; isoeugenol; isolongifolanone; isomethyl ionones; isononanol; isononyl acetate; isopulegol; lavendin oil; lemongrass oil; linalool; linalyl acetate; LRG 201; 1-menthol; 2-methyl-3-(p-isopropylphenyl)propanal; 2-methyl-3-(p-t-butylphenyl) propanal; 3-methyl-2-pentyl-cyclopentanone; 3-methyl-5-phenyl-pentanol; alpha and beta methyl naphthyl ketones; methyl ionones; methyl dihydrojasmonate; methyl naphthyl ether; methyl 4-propyl phenyl ether; Mousse de chene Yugo; Musk ambrette; myrtenol; naroli oil; nonanediol-1;3-diacetate; nonanol; nonanolide-1,4, nopol acetate; 1,2,3,4,5,6,7,8-octahydro-2,3,8,8-tetramethyl-2-acetyl-naphthalene, available under the trademark "ISO-E-SUPER"; octanol; Oppoponax resinoid; orange oil; p-t-amylcyclohexanone; p-t-butylmethylhydrocinnamic aldehyde; 2-phenylethanol; 2-phenylethyl acetate; 2-phenylpropanol; 3-phenylpropanol; para-menthan-7-ol; para-t-butylphenyl methyl other; patchouli oil: pelargene; petitgrain oil; phenoxyethyl isobutyrate; phenylacetaldehyde diethyl acetal; phenylacetaldehyde dimethyl acetal; phenylethyl n-butyl ether; phenylethyl isoamyl ether; phenylethylphenyl acetate; pimento leaf oil; rose-d-oxide; Sandalone; styrallyl acetate) 1,1,4,4-tetramethyl-6-acetyl-7-ethyl-1,2,3,4-tetrahydronaphthalene, available under the trademark "VERSALIDE"; 3,3,5-trimethyl hexyl acetate; 3,5,5-trimethylcyclohexanol; terpineol; terpinyl acetate; tetrahydrogeraniol; tetrahydrolinalool; tetrahydromuguol; tetrahydromyrcenol; thyme oil; trichloromethylphenycarbinyl acetate; tricyclodecenyl acetate; tricyclodecenyl propionate; 10-undecen-1-al; gamma undecalactone; 10-undecen-1-ol undecanol; vanillin; vetiverol; vetiveryl acetate; vetyvert oil; acetate and propionate esters of alcohols in the list above; aromatic nitromusk fragrances; indane musk fragrances; isochroman musk fragrances; macrocyclic ketones; macrolactone musk fragrances; and tetralin musk fragrances.

Perfumes frequently include solvents or diluents, for example: ethanol, isopropanol, diethylene glycol monoethyl ether, dipropylene glycol, diethyl phthalate and triethyl citrate.

Perfumes which are used in this invention may, if desired, have deodorant properties as disclosed in U.S. Pat. No. 4,303,679, U.S. Pat. No. 4,663,068 and EP-A-545556.

These perfumes may be incorporated into the particulate composition to be compacted by conventional means, such as by spraying onto the composition, or by adsorption onto a solid carrier which is incorporated into the composition. One particular type of perfume-containing particles is described in WO 96/21719 (Unilever).

Enzymes

The tablets of the first aspect of the present invention may contain one of the detergency enzymes well known in the art for their ability to degrade various soils and stains and so aid in their removal. An enzyme is a required constituent of tablets according to the second aspect of the invention.

Suitable enzymes include various proteases, cellulases, lipases, amylases, oxidases and mixtures thereof, which are designed to remove a variety of soils and stains from fabrics. Cellulases have a fabric softening function also. Detergency enzymes are commonly employed in the form of particles or marumes, optionally with a protective coating, in amount of from about 0.01% often from 0.1% to about 3% by weight of the tablet. A total enzyme content may exceed 3% but is unlikely to exceed 5%. The amount of any one enzyme is likely to tie in a range from 0.01% to 3% by weight of the whole tablet.

Detergent-active Compounds

Detergent-active compounds are suitably present in an amount of from 2% or 5% up to 50 wt %, more preferably from 5% or 8% up to 40 wt % of the whole tablet. These will most usually be anionic and nonionic surfactants and mixtures of the two. Amphoteric (including zwitterionic) and less commonly cationic detergents can also be used.

Anionic Surfactant Compounds

Synthetic (i.e. non-soap) anionic surfactants are well known to those skilled in the art. The anionic surfactant may comprise, wholly or predominantly, linear alkyl benzene sulphonate of the formula

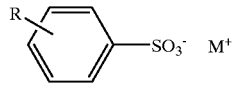

where R is linear alkyl of 8 to 15 carbon atoms and $M^+$ is a solubilising cation, especially sodium.

Primary alkyl sulphate having the formula $$ROSO_3^-M^+$$

in which R is an alkyl or alkenyl chain of 8 to 18 carbon atoms especially 10 to 14 carbon atoms and $M^+$ is a solubilising cation, is also commercially significant as an anionic surfactant and may be used in this invention.

Frequently, such linear alkyl benzene sulphonate or primary alkyl sulphate of the formula above, or a mixture thereof will be the desired non-soap anionic surfactant and may provide 75 to 100 wt % of any anionic non-soap surfactant in the composition.

Examples of other non-soap anionic surfactants include olefin sulphonates; alkane sulphonates; dialkyl sulphosuccinates; and fatty acid ester sulphonates.

One or more soaps of fatty acids may also be included in addition to non-soap anionic surfactant. Examples are sodium soaps derived from the fatty acids from coconut oil, beef tallow, sunflower or hardened rapeseed oil.

Nonionic Surfactant Compounds

Nonionic surfactant compounds include in particular the reaction products of compounds having a hydrophobic group and a reactive hydrogen atom, for example, aliphatic alcohols, acids, amides or alkyl phenols with alkylene oxides, especially ethylene oxide.

Specific nonionic surfactant compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine.

Especially preferred are the primary and secondary alcohol ethoxylates, especially the $C_{9-11}$ and $C_{12-15}$ primary and secondary alcohols ethoxylated with an average of from 3 to 20 moles of ethylene oxide per mole of alcohol.

Amphoteric Surfactants

Amphoteric surfactants which may be used jointly with anionic or nonionic surfactants or both include amphopropionates of the formula:

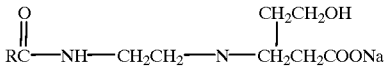

where RCO is a acyl group of 8 to 18 carbon atoms, especially coconut acyl.

The category of amphoteric surfactants also includes amine oxides and also zwitterionic surfactants, notably betaines of the general formula

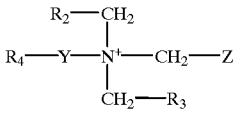

where $R_4$ is an aliphatic hydrocarbon chain which contains 7 to 17 carbon atoms, $R_2$ and $R_3$ are independently hydrogen, alkyl of 1 to 4 carbon atoms or hydroxyalkyl of 1 to 4 carbon atoms such as $CH_2OH$, Y is $CH_2$ or of the form $CONHCH_2CH_2CH_2$ (amidopropyl betaine);

Z is either a $COO^-$ (carboxybetaine), or of the form $CHOHCH_2SO_3$— (sulfobetaine or hydroxy sultaine).

Another example of amphoteric surfactant is amine oxide of the formula

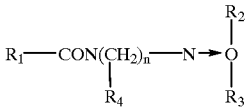

where $R_1$ is $C_{10}$ to $C_{20}$ alkyl or alkenyl $R_2$, $R_3$ and $R_4$ are each hydrogen or $C_1$ to $C_4$ alkyl while n is from 1 to 5.

Detergency Builder

The detergent tablets of the invention contain one or more detergency builders, suitably in an amount of from 5 to 80 wt %, preferably from 20 to 80 wt %. These builders may be either water-soluble or water-insoluble, and a mixture of the two is also included within the scope of the present invention.

Water-soluble phosphorus-containing inorganic detergency builders include the sodium and potassium orthophosphates, metaphosphates, pyrophosphates and polyphosphates.

Alkali metal aluminosilicates are strongly favoured as environmentally acceptable water-insoluble builders for fabric washing. Alkali metal (preferably sodium; aluminosilicates may be either crystalline or amorphous or mixtures thereof, having the general formula:

$$0.8–1.5Na_2O.Al_2O_3.0.8–6SiO_2.xH_2O$$

These materials contain some bound water (indicated as "xH2O") and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, the zeolite P described and claimed in EP 384070 (Unilever) which is also referred to as zeolite MAP and mixtures thereof. Zeolite MAP is available from Crosfields under their designation Zeolite A24.

Conceivably, water-insoluble detergency builder could be a crystalline layered sodium silicate as described in U.S. Pat. No. 4,664,839.

NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3,417,649 and DE-A-3,742,043. Other such layered silicates, which can be used have the general formula $NaMSi_xO_{2x+1}.yH_2O$ wherein M is sodium or hydrogen, x is a number from 1.9 to 4, preferably 2, and y is a number from 0 to 20, preferably 0.

Crystalline layered silicate may be used in the form of granules which also contain citric acid.

Non-phosphorous water-soluble builders may be organic or inorganic. Inorganic builders that may be present include alkali metal (generally sodium) carbonate; while organic builders include polydarboxylate polymers, such as polyacrylates and acrylic/maleic copolymers, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Alkali metal silicate, particularly sodium ortho-, meta- or disilicate has detergency building properties and may be used in substantial quantity in tablets for machine dishwashing. It is desirably included in smaller quantities in tablets for fabric washing. The presence of such alkali metal silicates may be advantageous in providing protection against the corrosion of metal parts in washing machines, besides providing some detergency building.

The detergency builder may also comprise an organic builder such as NTA (trisodium nitrilotriacetate monohydrate).

Tablet compositions preferably include polycarboxylate polymers, more especially polyacrylates and acrylic/maleic copolymers which can function as builders and also inhibit unwanted deposition onto fabric from the wash liquor.

If a composition is formulated to have low phosphate, the amount of inorganic phosphate builder may be less than 5 wt % of the tablet composition.

Disintegrants

A tablet of this invention may include a material which functions as a disintegrant. Such a material may be such as to swell on contact with water, thus subjecting the compacted tablet composition to internal pressure.

A number of materials are known for use as swelling disintegrants in pharmaceutical tablets and these may be used in detergent tablets of this invention. Examples include organic materials such as starches, for example, corn, maize, rice and potato starches and start derivatives, such as Primojel (Trade Mark) carboxymethyl starch and Explotab (Trade Mark) sodium starch glycolate; celluloses and cellulose derivatives, for example, Courlose (Trade Mark) and Nymcel (Trade Mark) sodium carboxymethyl cellulose, Ac-di-Sol (Trade Mark) cross-linked modified cellulose, and Hanfloc (Trade Mark) microcrystalline cellulosic fibres; and various synthetic organic polymers, notably cross-linked polvinyl pyrrolidone, for example, Polyplasdone (Trade Mark) Xl or Kollidon (Trade Mark) CL. Inorganic swelling disintegrants include bentonite clay.

Polymer Binder

Tablets of this invention may include an organic water-soluble polymer, serving as a binder when the particles are compacted into tablets. This polymer may be a polycarboxylate included as a supplementary builder, as mentioned earlier. It may be applied as a coating to some or all of the constituent particles prior to compaction.

As taught in our EP-A-522766, such polymers can function to enhance tablet disintegration at the time of use, as well as acting as a binder to enhance tablet strength prior to use.

It is preferred that such a binder material, if present, should melt at a temperature of at least 35° C., better at 40° C. or above, which is above ambient temperatures in many temperate countries. For use in hotter countries it will be preferred that the melting temperature is somewhat above 40° C., so as to be above the ambient temperature.

For convenience the melting temperature of the binder material should be below 80° C.

Preferred binder materials are synthetic organic polymers of appropriate melting temperature, especially polyethylene glycol. Polyethylene glycol of average molecular weight 1500 (PEG 1500) melts at 45° C. and has proved suitable. Polyethylene glycol of higher molecular weight, notably 4000 or 6000, can also be found.

Other possibilities are polyvinylpyrrolidone, and polyacrylates and water-soluble acrylate copolymers.

The binder may suitably be applied to the particles by spraying, e.g. so as a solution or dispersion. It may be applied to particles which contain organic surfactant. If used, the binder is preferably used in an amount within the range from 0.1 to 10% by weight of the tablet composition, more preferably the amount is at least 1% or even at least 3% by weight of the tablets. Preferably the amount is not over 8% or even 6% by weight unless the binder serves some other additional function.

Water-soluble Disintegrants

Published patent applications have revealed that certain water-soluble materials function to promote tablet disintegration at the time of use and such materials may be used in tablets of this invention so as an alternative to, or in addition to, and insoluble but water-swellable disintegrant.

Such materials include compounds of high water-solubility, a specified form of sodium tripolyphosphate and combinations of these two. Such material may be present as at least 10 or 15% of the composition of a tablet or region thereof, possibly at least 25% up to 50 or 60%, possibly more.

Highly water soluble materials, which are one of the two possibilities are compounds, especially salts, with a solubility at 20° C. of at least 50 gms per 100 gms of water.

Such materials have been mentioned in our published patent applications including EP-A-711827 and EP-A-838519. A solubility of at least 50 grams per 100 grams of water at 20° C. is an exceptionally high solubility: many materials which are classified so as water soluble are less soluble than this.

Some highly water-soluble materials which may be used are listed below, with their solubilities expressed so as grams of solid to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |
| Sodium acetate, anhydrous | 119 |
| Sodium acetate trihydrate | 76 |
| Magnesium sulphate $7H_2O$ | 71 |
| Potassium acetate | >200 |

By contrast the solubilities of some other common materials at 20° C. are:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

Preferably this highly water soluble material is incorporated so as particles of the material in a substantially pure form (i.e. each such particle contains over 95% by weight of the material). However, the said particles may contain material of such solubility in a mixture with other material, provided that material of the specified solubility provides at least 50% by weight of these particles, better at least 80%.

A particularly preferred material, sodium acetate trihydrate, is normally produced by a crystallisation process, so that the crystallised product contains 3 molecules of water of crystallisation for each sodium and acetate ion pair. Sodium acetate in an incompletely hydrated form, which may be produced by a spray-drying route, can also be used.

Another possibility is that the said particles which promote disintegration are particles containing sodium tripolyphosphate with more than 50% of it (by weight of the particles) in the anhydrous phase I form. Such particles may contain at least 80% by weight tripolyphosphate and possibly at least 95%. Detergent tablets containing such material are the subject of our EP-A-839906.

Sodium tripolyphosphate is very well known so as a sequestering builder in detergent compositions. It exists in a hydrated form and two crystalline anhydrous forms. These are the normal crystalline anhydrous form, known so as phase II which is the low temperature form, and phase I which is stable at high temperature. The conversion of phase II to phase I proceeds fairly rapidly on heating above the transition temperature, which is about 420° C., but the reverse reaction is slow. Consequently phase I sodium tripolyphosphate is metastable at ambient temperature.

A process for the manufacture of particles containing a high proportion of the phase I form of sodium tripolyphosphate by spray drying below 420° C. is given in U.S. Pat. No. 4,536,377.

Particles which contain this phase I form will often contain the phase I form of sodium tripolyphosphate so as at least 55% by weight of the tripolyphosphate in the particles. Other forms of sodium tripolyphosphate will usually be present to a lesser extent. Other salts may be included in the particles, although that is not preferred.

Desirably, this sodium tripolyphosphate is partially hydrated. The extent of hydration should be at least 1% by weight of the sodium tripolyphosphate in the particles. It may lie in a range from 2.5 to 4%, or it may be higher, e.g. up to 8%.

Suitable material is commercially available. Suppliers include Rhone-Poulenc, France and Albright & Wilson, UK.

"Rhodiaphos HPA 3.5" from Rhone-Poulenc has been found particularly suitable. It is a characteristic of this grade of sodium tripolyphosphate that it hydrates very rapidly in a standard Olten test. We have found that it hydrates as quickly as anhydrous sodium tripolyphosphate, yet the pre-hydration appears to be beneficial in avoiding unwanted crystallisation of the hexahydrate when the material comes into contact with water at the time of use.

Other Ingredients

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino)stilbene disulphonate; and Tinopal CBS is disodium 2,2'-bis-(phenylstyryl)disulphonate.

An antifoam material is advantageously included, especially if a detergent tablet is primarily intended for use in front-loading drum-type automatic washing machines. Antifoam materials in granular form are described in EP 266863A (Unilever). Such antifoam particles typically comprise a mixture of silicone oil, petroleum jelly, hydrophobic silica and alkyl phosphate so as antifoam active material, sorbed onto a porous absorbed water-soluble carbonate-based inorganic carrier material.

Further ingredients which can optionally be employed in fabric washing detergent tablet of the invention include anti-redeposition agents such as sodium carboxymethylcellulose, straight-chain polyvinyl pyrrolidone (which can also act as a binder, as mentioned earlier) and the cellulose ethers such as methyl cellulose and ethyl hydroxyethyl cellulose, heavy metal sequestrants such as EDTA; soil release polymers, fabric softening agents, other fabric conditioning agents, colorants or coloured speckles.

Particle Size and Distribution

The discrete regions of a detergent tablet of this invention, are each a matrix of compacted particles. Preferably the particulate mixture of particles, from which each tablet region is compacted, has an average particle size before compaction in the range from 200 to 2000 $\mu$m, more preferably from 250 to 1400 $\mu$m. Fine particles, smaller than 180 $\mu$m or 200 $\mu$m may be eliminated by sieving before tableting, if desired, although we have observed that this is not always essential.

While the starting particulate composition may in principle have any bulk density, the present invention is especially relevant to tablets made by compacting powders of relatively high bulk density, because of their greater tendency to exhibit disintegration and dispersion problems.

Such tablets have the advantage that, as compared with a tablet derived from a low bulk density powder, a given dose of composition can be presented as a smaller tablet.

Thus the starting particulate composition may suitably have a bulk density of at least 400 g/liter, preferably at least 550 g/liter, and perhaps at least 600 g/liter.

Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 361339A (Unilever) and EP 390251A (Unilever), are inherently suitable for use in the present invention.

Porosity

The step of compacting the particles reduces the porosity of the composition. Porosity is conveniently expressed as the percentage of volume which is air.

The air content of a tablet or region of a tablet can be calculated from the volume and weight of the tablet or region, provided the air-free density of the solid content is known. The latter can be measured by compressing a sample of the material under vacuum with a very high applied force, then measuring the weight and volume of the resulting solid.

The percentage air content of a tablet or region of a tablet varies inversely with the pressure applied to compact the composition while the strength of the tablet or region varies with the pressure applied to bring about compaction. Thus the greater the compaction pressure, the stronger the tablet or region becomes but the smaller the air volume within.

The invention may be applied when compacting particulate detergent composition to give tablets with a wide range of porosities. Specifically included among possible porosities it a porosity of up to 38% air volume, e.g. from 10 or 15 better 25% up to 35% air by volume in the tablet.

The following non-limiting Examples illustrate the invention.

EXAMPLE 1

40 g detergent tablets were made on a Fette tableting machine according to three different formulations. For making two-layer tablets the composition for the smaller layer was first put into the tableting mould and lightly compacted. The remainder of the composition to provide the thicker layer was next put into the tableting mould and this composition together with the thinner; layer already formed were compacted with greater force thereby completing the compaction of the thinner layer, compacting the thicker layer and uniting the two layers together.

Each of the formulations were based on the following granulated detergent base powder:

| | weight % |
|---|---|
| Na - LAS | 24.47 |
| Nonionic (7EO) | 5.27 |
| Nonionic (3EO) | 5.55 |
| Soap | 0.75 |
| Sodium Tripolyphosphate | 37.98 |
| AA/MA copolymer (70:30) | 3.35 |
| Sodium silicate | 8.96 |
| Sodium carboxy methyl cellulose | 0.48 |
| Fluorescer | 0.33 |
| Perfume (sprayed) | 0.86 |
| Minor Ingredients/Moisture | 12.00 |

The base powder was then mixed with various further ingredients, including coated sodium percarbonate, TAED granules and enzymes.

The coated sodium percarbonate used in the compositions was in the form of particles with mean particle size lying in a range between 475$\mu$ and 800$\mu$. The content of fines, smaller than 180$\mu$, was below 2% of the total weight. Available oxygen was approximately 13.5%.

The coating provided 2.7% of the weight of these particles and consisted of sodium chloride and sodium carbonate in equal amounts by weight, with sodium sulphate impurity present as 10% of the coating.

TAED was incorporated as granules With a mean size of 700μ containing 83% TAED. Savinase 12.0TX is a protease.

Three types of tablet were made. Both tablets 1 and tablets 2 were made with two-layers. Comparative tablets A were made with a single layer. Both types of two layer tablets were made with a thin layer being 25% of the tablet weight, and a thick layer being 75% of the tablet weight. In tablet 1, the formulation is such that both layers would dissolve at approximately the same rate, whilst tablet 2 is formulated to allow for some sequential dissolution of the layers.

The compositions are set out in more detail in the following table (in wt % of the tablet/layer):

| | Comparative Tablet A | Tablet 1 | | Tablet 2 | |
|---|---|---|---|---|---|
| | Single Layer | Thin Layer | Thick Layer | Thin Layer | Thick Layer |
| Base powder | 45.4 | 47.4 | 44.8 | 29.9 | 50.6 |
| Anti-foam granules | 3.2 | — | 4.3 | — | 4.3 |
| STP, HPA | 30.3 | 30.0 | 30.4 | 47.5 | 24.5 |
| TAED granules | 3.4 | 13.5 | — | 13.5 | — |
| Coated Percarbonate | 15.1 | — | 20.2 | — | 20.2 |
| Heavy metal sequestrant | 1.0 | 4.0 | — | 4.0 | — |
| Coloured speckles | 0.8 | 3.0 | — | 3.0 | — |
| Savinase 12.0TX | 0.4 | 1.6 | — | 1.6 | — |
| Lipolase | 0.03 | 0.1 | — | 0.1 | — |

All three tablets contain the same amount of each ingredient.

These tablets were packed in closed wrappers formed from polymer film. The packages were stored at 37° C. and 70% relative humidity for varying periods of time. After storage, the tablets were analysed for the content of TAED and enzyme which remained.

The amount of TAED remaining expressed as a percentage of the (theoretical)amount initially included in the tablet is set out in the table below.

| T (weeks) | 0 | 2 | 4 | 8 |
|---|---|---|---|---|
| Comparative Tablet A | 87.5 | 78.0 | 69.4 | 54.2 |
| Tablet 1 | 92.2 | 89.8 | 94.3 | 81.9 |
| Tablet 2 | 91.1 | 84.1 | 80.8 | 70.4 |

The amount of Savinase remaining expressed as a percentage of the (theoretical)amount initially included in the tablet is set out in the table below.

| T (weeks) | 0 | 2 | 4 | 8 |
|---|---|---|---|---|
| Comparative Tablet A | 96.5 | 92.3 | 77.3 | 48.9 |
| Tablet 1 | 100.2 | 92.3 | 101.8 | 78.1 |
| Tablet 2 | 91.9 | 103.4 | 94.7 | 75.0 |

The percentage of perfume remaining in the comparative tablet A and in both layers of tablet 1 was determined by HPLC analysis after 4 weeks storage. The results are shown below:

| | % Remaining |
|---|---|
| Comparative Tablet A | 56.4 |
| Tablet 1 - Thin Layer | 91.9 |
| Tablet 1 - Thick Layer | 78.9 |
| Tablet 1 - Overall | 82.1 |

These results, which have an experimental error of up to 10%, show that the stability of the TAED, enzyme and perfume is greatly improved in a tablet of the present invention, compared to the comparative tablet in which the sodium percarbonate and bleach activator (TAED) is only segregated by coating of the sodium percarbonate particles.

EXAMPLE 2

The above experiments were repeated, using a zeolite built detergent base powder, with the following composition:

| | weight % |
|---|---|
| Na - LAS | 20.66 |
| Nonionic (7EO) | 6.09 |
| Nonionic (3EO) | 3.25 |
| Soap | 1.65 |
| Zeolite | 46.29 |
| Sodium carbonate | 6.94 |
| Sodium acetate trihydrate | 5.92 |
| Sodium carboxy methyl cellulose | 0.93 |
| Perfume (sprayed) | 0.84 |
| Minor Ingredients/Moisture | 7.43 |

As in example 1, three types of tablets were made. Both tablets 3 and 4 were made with two-layers. Comparative tablet (was made with a single layer. Both types of two layer tablets were made with a thin layer being 25% of the tablet weight, and a thick layer being 75% of the tablet weight. In tablet 3, the formulation is such that both layers would dissolve at approximately the same rate, whilst tablet 4 is formulated to allow for some sequential dissolution of the layers.

The compositions are set out in more detail in the following table (in wt % of the tablet/layer):

| | Comparative Tablet B | Tablet 3 | | Tablet 4 | |
|---|---|---|---|---|---|
| | Single Layer | Thin Layer | Thick Layer | Thin Layer | Thick Layer |
| Base powder | 45.4 | 35.8 | 48.6 | 44.4 | 45.7 |
| Anti-foam granules | 1.8 | — | 2.4 | — | 2.4 |
| Fluorescer | 1.0 | — | 1.3 | — | 1.3 |
| TAED granules | 5.1 | 20.6 | — | 20.6 | — |
| Coated Percarbonate | 14.6 | — | 19.4 | — | 19.4 |
| AA/MA copolymer (70:30) | 1.3 | — | 1.8 | — | 1.8 |
| Soil release polymer | 1.1 | — | 1.5 | — | 1.5 |
| Heavy metal sequestrant | 0.7 | 2.7 | — | 2.7 | — |
| Sodium disilicate | 3.5 | — | 4.7 | — | 4.7 |
| Na acetate trihydrate | 22.8 | 31.4 | 20.0 | 22.8 | 22.8 |
| Coloured speckles | 1.4 | 5.6 | — | 5.6 | — |
| Savinase 12.0TX | 0.8 | 3.2 | — | 3.2 | — |
| Lipolase | 0.1 | 0.4 | — | 0.4 | — |

All three tablets contain the same amount of each ingredient.

These tablets were stored under the same conditions as the tablets in example 1.

The amount of TAED remaining expressed as a percentage of the (theoretical)amount initially included in the tablet is set out in the table below.

| T (weeks) | 0 | 2 | 4 | 8 |
|---|---|---|---|---|
| Comparative Tablet B | 99.2 | 89.7 | 83.6 | 73.6 |
| Tablet 3 | 101.2 | 94.2 | 94.4 | 91.6 |
| Tablet 4 | 95.6 | 94.1 | 95.6 | 89.7 |

The amount of Savinase remaining expressed as a percentage of the (theoretical)amount initially included in the tablet is set out in the table below.

| T (weeks) | 0 | 2 | 4 | 8 |
|---|---|---|---|---|
| Comparative Tablet B | 91.9 | 89.6 | 86.5 | 77.9 |
| Tablet 3 | 89.2 | 87.2 | 84.1 | 82.2 |
| Tablet 4 | 92.3 | 89.2 | 88.4 | 88.4 |

The percentage of perfume remaining for the comparative tablet and both layers of tablet 3 was determined by HPLC analysis after 4 weeks storage. The results are shown below:

| | % Remaining |
|---|---|
| Comparative Tablet B | 55.3 |
| Tablet 3 - Thin Layer | 91.1 |
| Tablet 3 - Thick Layer | 84.4 |
| Tablet 3 - Overall | 86.2 |

These results also have an experimental error of up to ±10%.

EXAMPLE 3

The tablets described above were used to wash standard test fabrics and cloths with standard stains to ascertain their relative washing performance. The tablets were tested prior to storage, and also after being stored for eight weeks in closed wrappers at 37° C. at 70% relative humidity.

The test involves washing the test fabrics and cloths bearing test stains under standard conditions (using a 60° C. program of a European Miele washing machine, with a water hardness of 27° FH).

Washing performance is assessed by determining the increase in reflectance of the washed material at 460 nm over the reflectance of the material prior to washing. An increase in the reflectance corresponds to a cleaner fabric/cloth.

Prior to the storage of the tablets, for all the test fabrics and test stains tried, the tablets of the invention showed no statistically significant difference (95% Confidence Level) in performance on each fabric or stain compared to the comparative single-layer tablets (tablets 1 and 2 vs. comparative tablet A; and tablets 3 and 4 vs. comparative tablet B).

However, after storage, the tablets of the invention showed statistically significant better performance against certain fabrics and stains than the relevant comparative tablets, whilst against the remaining fabrics and stains tested, again no statistically significant change was observed between the tablets of the invention and the relevant comparative tablets.

More specifically, both tablets 1 and 2 showed a statistically significant increase (95% Confidence Level) in performance, as compared against comparative tablet A, for the test fabrics AS-10, EMPA-114 and BC1 and against the following standard stains, cherry, blackcurrant, and strawberry. These test fabrics and stains are known to be bleach or enzyme sensitive. For all the other fabrics and stains tested, there was an increase in performance by tablets 1 and 2 over comparative tablet A, although these results did not achieve statistical significance at a 95% confidence level.

Tablets 3 and 4 only showed a statistically significant increase (95% Confidence Level) in the performance, as compared against comparative tablet B, for the test fabrics AS-10 and EMPA-114.

What is claimed is:

1. A detergent tablet of compressed particulate composition comprising a detergent-active compound, a detergency builder, a bleach system comprising sodium percarbonate in the form of particles having a coating of water-soluble material and at least one bleach activator, and optionally other detergent ingredients, where the tablet comprises a plurality of discrete regions, each of which is at least 10% of the total weight of the tablet, and wherein one or more regions contain at least 80% of the sodium percarbonate present in the tablet and the bleach activator which is present in an amount of not more than 20% in the tablet while one or more other regions of the tablet contain at a least 80% of the bleach activator in the tablet and the percarbonate which is present in an amount of not more than 20% in the tablet.

2. A tablet according to claim 1 wherein one or more regions contain at least 90% of the sodium percarbonate present in the tablet and the bleach activator which is present in an amount of not more than 10% in the tablet while one or more other regions of the tablet contain at least 90% of the bleach activator in the tablet and the percarbonate which is present in an amount of not more than 10% in the tablet.

3. A tablet according to claim 1 wherein the bleach activator is selected from the group consisting of N-diacylated and N,N-polyacylated amine bleach activator.

4. A tablet according to claim 1 additionally comprising at least one enzyme, wherein the enzymes and bleach activators are concentrated in the same region of the tablet, which is a different region to that in which the particles containing the sodium percarbonate within a water-soluble coating are concentrated.

5. A tablet according to claim 4 wherein the said region(s) which contain at least 80% of the sodium percarbonate present in the tablet do not contain more than 20% of the enzyme present in the tablet.

6. A detergent tablet of compressed particulate composition comprising a detergent-active compound, a detergency builder, a bleach system comprising sodium percarbonate in the form of particles having a coating of water-soluble material, at least one enzyme, and optionally other detergent ingredients, where the tablet comprises a plurality of discrete regions, each of which is at least 10% of the total weight of the tablet, and wherein one or more regions contain at least 80% of the sodium percarbonate present in the tablet and the enzyme which is present in an amount of not more than 20% in the tablet while one or more other regions of the tablet contain at least 80% of the enzyme and the percarbonate which is present in an amount of not more than 20% in the tablet.

7. A tablet according to claim 6 wherein one or more regions contain at least 90% of the sodium percarbonate present in the tablet and the enzyme which is present in an amount of not more than 10% in the tablet while one or more other regions of the tablet contain at least 90% of the enzyme and the percarbonate which is present in an amount of not more than 10% in the tablet.

8. A tablet according to either claim 1 or claim 6 wherein the amount of detergent active is from 5 to 40% by weight of the whole tablet and the detergency builder comprises alkali metal aluminosilicate in an amount from 5 to 80% by weight of the whole tablet.

* * * * *